US005112263A

United States Patent [19]

Penillard et al.

[11] Patent Number: 5,112,263

[45] Date of Patent: May 12, 1992

[54] MODULAR LIQUID FLOW DEVICE, IN PARTICULAR A WATER CONSTRUCTION KIT

[75] Inventors: Philippe Penillard; Aimee Penillard, both of Le Vesinet, France

[73] Assignee: Interlego A.G., Baar, Switzerland

[21] Appl. No.: 525,738

[22] Filed: May 21, 1990

[30] Foreign Application Priority Data

May 26, 1989 [FR] France ..... 89 06958

[51] Int. Cl.[5] ..... A63H 33/10

[52] U.S. Cl. ..... 446/89; 446/85; 446/90

[58] Field of Search ..... 446/75, 85, 89, 90, 446/128, 166

[56] References Cited

U.S. PATENT DOCUMENTS

| | | | |
|---|---|---|---|
| 3,205,611 | 9/1965 | Onanian | 446/89 |
| 3,302,949 | 2/1967 | Wolfe | 446/89 X |
| 3,425,152 | 2/1969 | Foulkes | 446/166 |
| 4,080,752 | 3/1978 | Burge | 446/89 |
| 4,349,983 | 9/1982 | Kilroy et al. | 446/75 |

FOREIGN PATENT DOCUMENTS

| | | | |
|---|---|---|---|
| 1478739 | 3/1970 | Fed. Rep. of Germany . | |
| 1472378 | 3/1967 | France . | |
| 1599102 | 8/1970 | France . | |
| 2048088 | 12/1980 | United Kingdom | 446/89 |
| 2185192 | 7/1987 | United Kingdom . | |

*Primary Examiner*—Robert A. Hafer
*Assistant Examiner*—Sam Rimell
*Attorney, Agent, or Firm*—Dennison, Meserole, Pollack & Scheiner

[57] ABSTRACT

A modular device including:

a receptacle (1) suitable for containing a liquid;

a support (5) connected to the receptacle to define, together with the receptacle, a structure extending in part above the level of the liquid contained in the receptacle, said structure being provided with assembly components in a first pattern (20, 21, 22);

a plurality of liquid-conveying elements (3) each possessing assembly components in a second pattern complementary to the first pattern, the elements being mounted on the structure in positions selected for conveying the liquid from one element to another and/or to the receptacle; and a liquid raising unit (6) for raising the liquid from the receptacle to a liquid-distribution box (4) co-operating with at least one of the liquid-conveying elements.

23 Claims, 7 Drawing Sheets

FIG.1
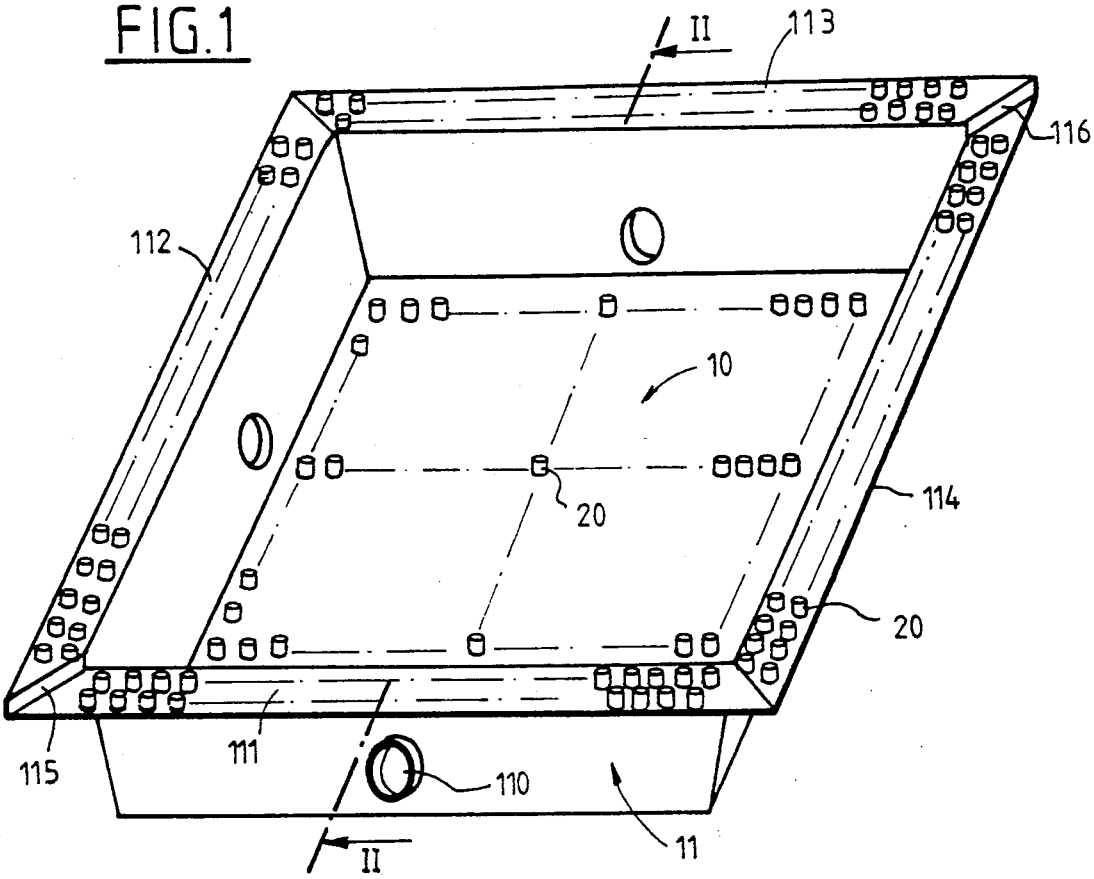
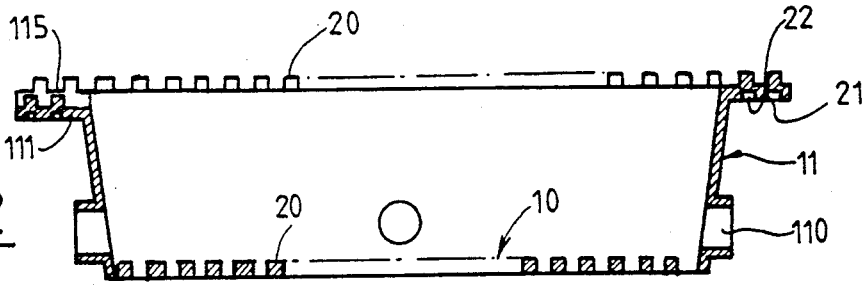
FIG.2
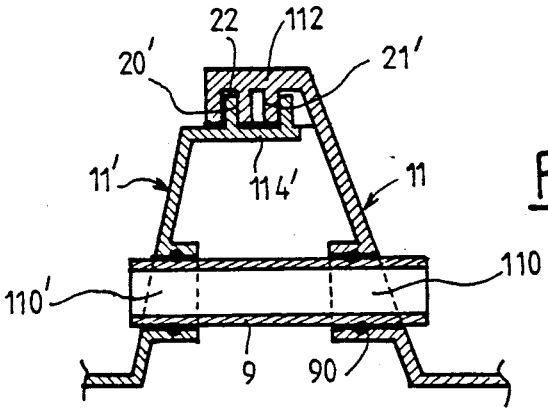
FIG.16

MODULAR LIQUID FLOW DEVICE, IN PARTICULAR A WATER CONSTRUCTION KIT

The invention relates to modular liquid flow devices.

It is advantageously, but not exclusively, applicable to the field of construction kits.

It may be particularly interesting, e.g. for educational purposes, to demonstrate the path followed by a fluid such as water within a construction kit, and to be able to modify the path at will.

It then becomes necessary to provide pieces of various shapes in order to offer a very wide variety of possible water paths.

In addition, when using such a kit, it is necessary to ensure some minimum degree of safety in order to avoid unwanted water flows from the kit.

In the past, satisfying these constraints has prevented modular devices being provided which are both simple to implement and particularly attractive as to the wide variety of aspects they are capable of offering.

The invention provides a solution to this problem.

It aims to propose a modular device enabling a wide variety of liquid flow paths to be constructed in simple manner.

Another object of the invention is to associate this simplicity of construction with a minimum degree of safety for safeguarding the environment outside the kit from unwanted liquid flows.

Another object of the invention is to provide closed circuit liquid flow requiring little energy consumption while nevertheless providing a liquid flow rate which is variable.

Another object of the invention is to propose a modular device in which at least some of its constituent pieces may be interchanged with pieces from already-existing construction kits.

In certain configurations, the invention also seeks to demonstrate in simple manner the driving effect that water may present.

Another object is to provide such a device at low cost.

The Applicants have observed that in order to provide a solution to the problem posed, it is advantageous for the various pieces of the device to be mutually interchangeable, thereby ensuring its modular nature and thus increasing the diversity of its structural forms.

According to a general characteristic of the invention, the proposed modular device comprises, in combination:

a receptacle suitable for containing a liquid;

support means suitable for being connected to the receptacle so as to define, together with said receptacle, a structure extending in part above the level of the liquid contained in the receptacle, said structure being provided with a standardized first assembly pattern, that is a uniform or otherwise predetermined pattern of assembly components;

a plurality of liquid-conveying elements each possessing a second assembly pattern complementary to the standardized first pattern, said elements being suitable for being mounted on said structure in positions selected for conveying the liquid from one to another and/or to the receptacle; and liquid-raising means for raising the liquid from the receptacle to liquid-distribution means co-operating with at least one of the liquid-conveying elements.

Other advantages and characteristics of the invention appear from examining the following detailed description and the accompanying drawings, in which:

FIG. 1 is a diagram of a receptacle for a device of the invention:

FIG. 2 is a section on II—II of FIG. 1;

FIG. 16 is a fragmentary diagrammatic section through two receptacles assembled together.

Figure 3:
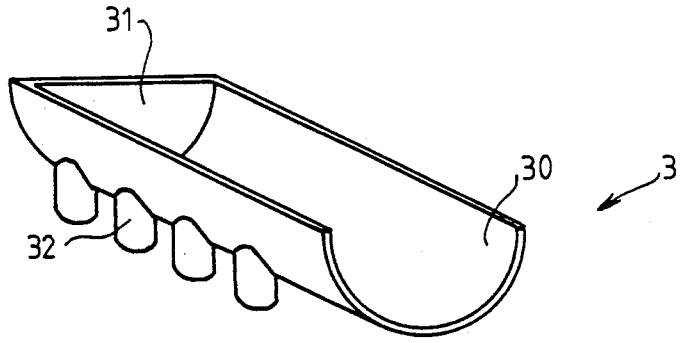
FIG. 3 is a diagrammatic perspective view of a liquid-conveying element.

The drawings include elements which are essentially definitive in nature. In this respect they form an integral portion of the description and serve not only to facilitate understanding of the following detailed description, but also, where appropriate, to contribute to defining the invention.

The various dimensions specified below are given purely by way of non-limiting, illustrative example.

The essential element of the invention, shown in FIGS. 1 and 2 is a water-receiving basin 1. The basin is generally prismatic in shape having a square base with a side of about 40 cm, and a depth of about 5 cm. It has a bottom wall 10 surrounded by a side wall 11 fitted with four cylindrical through orifices 110 situated substantially in the middle of each of the four flanks of the side wall, near the bottoms thereof, i.e. beneath the level of the water contained in the basin.

Each of the four flanks of the receptacle side wall has an outwardly-directed portion, thereby defining four rims 111, 112, 113, and 114. The rim 112 is connected to the lower rim 111 via a riser 115. The rim 113 which is parallel to and opposite the rim 111, extends the rim 112 and is connected to the rim 114 (at the same level as the rim 111) via a riser 116 similar to the riser 115.

The function of these rims at different heights is explained below.

The bottom wall and the rims of the receptacle include a first uniform or predetermined pattern of assembly components, for example of the type having co-operating studs, and more commonly known under the trademarks Duplo or Lego. Such a pattern is described in French patent No. 1 599 102 which is incorporated in the content of the present description where appropriate, in particular for providing assistance in defining said assembly pattern.

It is briefly recalled herein that assembling two elements using such a pattern requires at least one of the elements to include top projecting studs and the other element, e.g. in the form of an open-bottomed box, to include bottom studs in its cavity leaving gaps or hollows between one another and the side walls of the cavity. The spacing of the top projecting studs and the sizes of the bottom studs and the hollows are adjusted to enable the two elements to be assembled together by engaging the top projecting studs in the hollows of the corresponding element.

When the pattern is more particularly of the Duplo type, the top projecting studs are hollow having an inside diameter equal to about 6.7 mm and an outside diameter of about 9.4 mm. In contrast, with a Lego type pattern, the top studs are not hollow and their diameter is substantially one-half the outside diameter of the two hollow studs of the Duplo type pattern.

In general, when two elements are each provided with the predetermined assembly pattern for assembly purposes, it is implicit in the context of the present description that one of the elements includes a pattern portion which is complementary to another portion of the same pattern.

The bottom wall 10 of the receptacle 1 is provided with a plurality of projecting studs 20, as are the top faces of the four rims 111–114. In contrast, the bottom faces of the same rims include a plurality of bottom studs 21 and hollows 22 for co-operating with corresponding projecting studs on another element.

Figure 4:
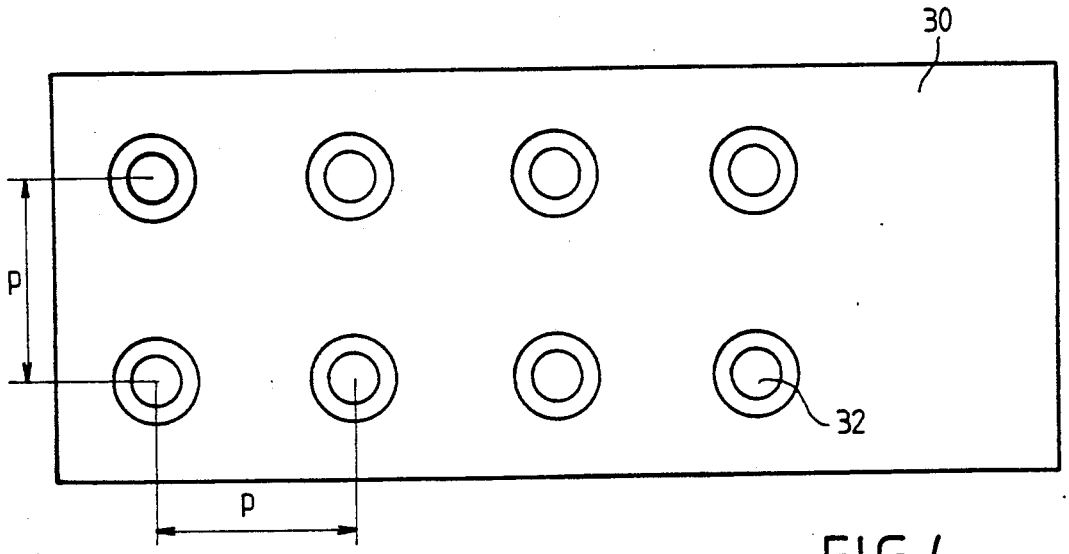
FIG. 4 is a bottom view corresponding to FIG. 3.
Figure 5:
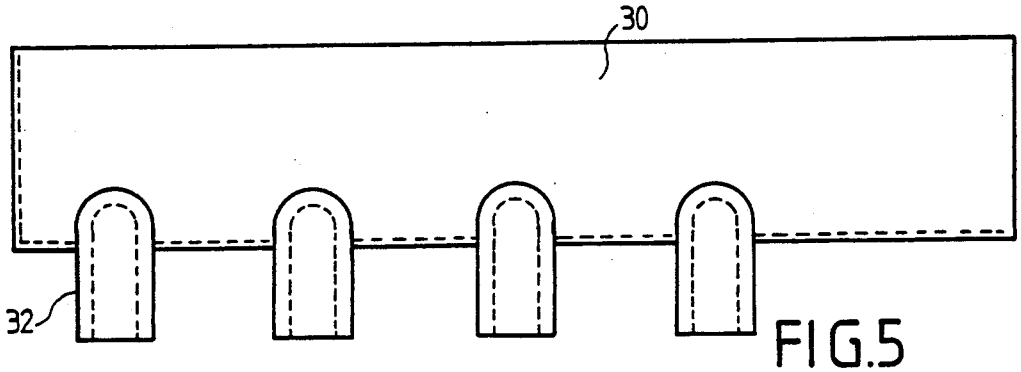
FIG. 5 is a side view corresponding to FIG. 4.

Another essential element of the invention, shown in FIGS. 3 to 5, consists in a water-conveying element such as a gutter 3.

The element has a curved, semi-cylindrical side wall 30 opening out at one end and closed at the other by an end wall 31 serving, as explained below, as water stop means.

In general, the outside face of the side wall 30, i.e. the face over which water does not stream, includes two rows of hollow projecting pegs 32 regularly spaced apart at a pitch p, with the pitch p being defined herein as the distance between the respective axes of two adjacent pegs. These two rows are themselves spaced apart at the same pitch p.

The disposition of the pegs on the gutter is remarkable in that the pitch p is substantially equal to 2.4 times the outside diameter of each peg. The Applicants have observed, surprisingly, that such a second assembly pattern enables a gutter to be assembled either to a brick having a Lego type standardized pattern, or else to a brick having a Duplo type standardized pattern, while nevertheless ensuring that the gutter is very well centered transversely on the brick (the longitudinal axis of the brick and the longitudinal axis of symmetry of the second assembly pattern then coinciding).

Figure 6:
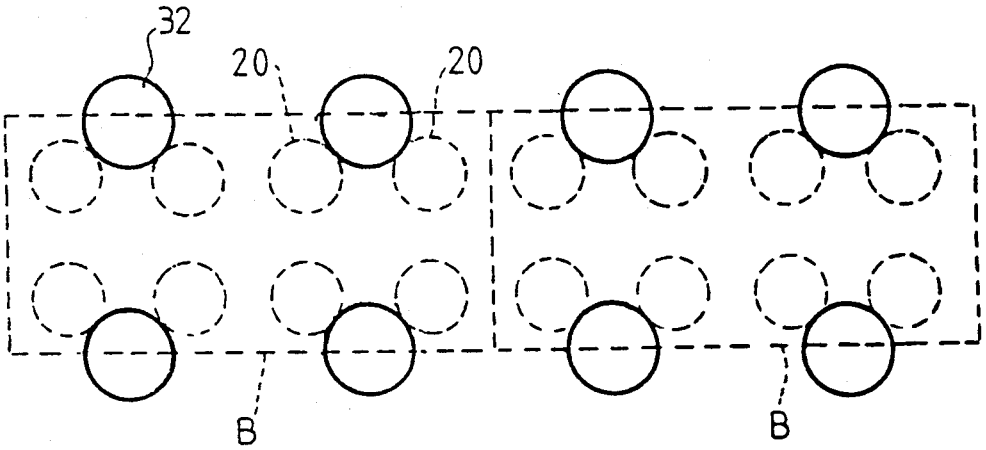
FIGS. 6 and 7 are diagrams illustrating how a liquid-conveying element is assembled on a support.

FIG. 6 shows a gutter assembled on two Lego B bricks. It can be seen that each projecting peg 32 is externally received in contact between pairs of adjacent top projecting studs 20 of a Lego brick.

Figure 7:
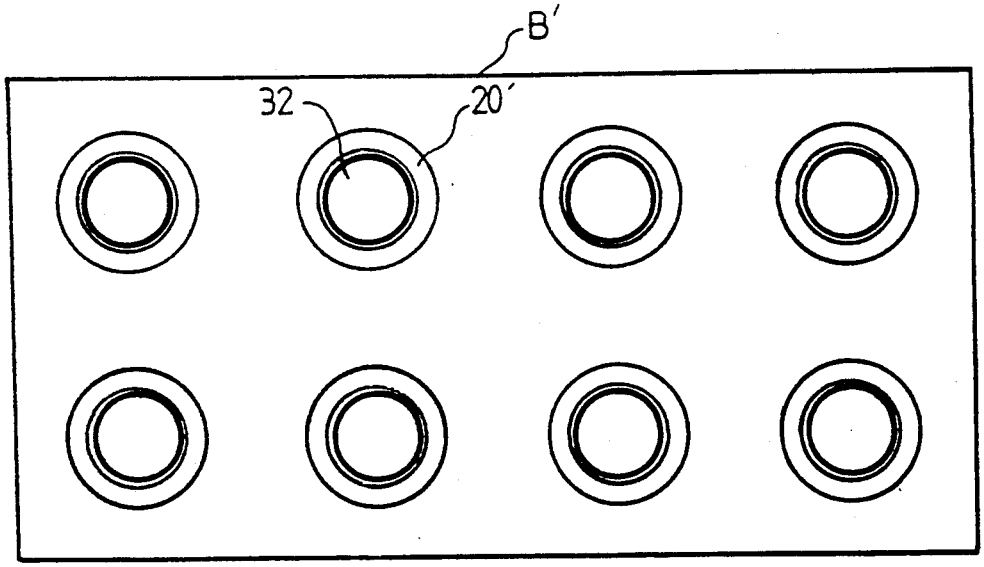

For assembly on a Duplo B' brick (FIG. 7), each projecting peg 32 is received by making contact inside a hollow projecting stud 20', with the outside diameter of a peg being substantially equal to the inside diameter of a hollow stud.

The gutter shown in FIGS. 3 to 5 is about 79 mm long, its diameter is about 32 mm, it possesses eight hollow studs organized as two rows of four regularly spaced-apart studs at a pitch of about 15.8 mm, and the outside diameter of each of them is equal to about 6.4 mm.

It may be observed here that the length of the gutter (79 mm) is equal to five times the pitch p. In general, the length of a gutter is advantageously in the range n.p to (n+1).p where n designates the number of pegs per row, thereby enabling the gutter to project beyond its support element. This excess length advantageously makes it possible to avoid the water jet leaving the gutter being disturbed by the edge of the gutter-support element.

Some gutters may be smaller, e.g. enabling them to be assembled in a centered position on a Duplo type base element, which is square in shape and includes only four projecting studs.

The hollows in the pegs 32 have the advantage of saving material, but solid pegs would also work.

It would also be possible to provide gutters with a base corresponding to the first assembly pattern of the Duplo or Lego type, assuming that it is not necessarily desired that the gutter should be centered on its support, or if its diameter does not enable the second assembly pattern to be applied thereto.

Figure 8:
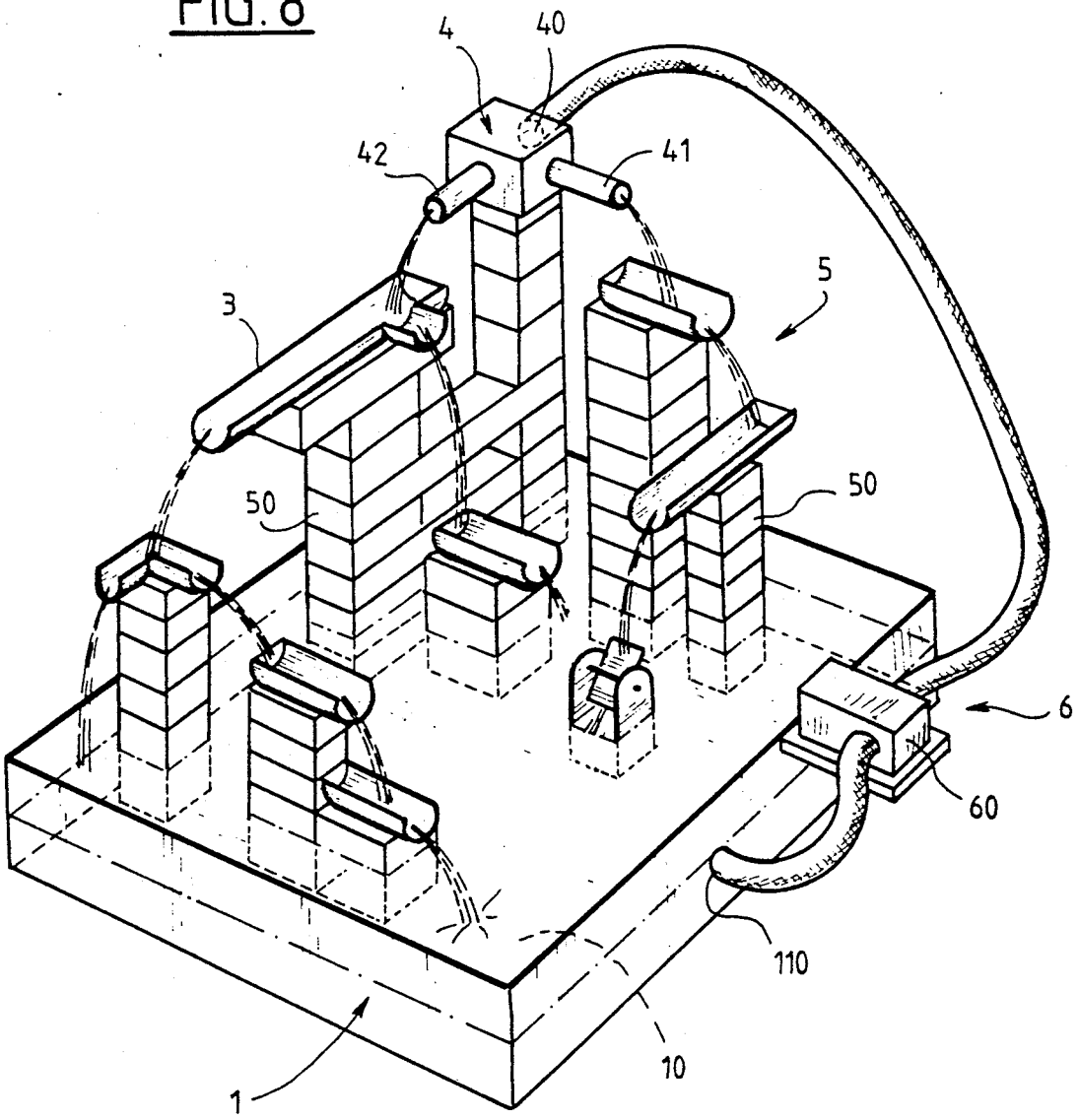
FIG. 8 is an overall diagrammatic view of one embodiment of a device of the invention.

FIG. 8 shows an embodiment of the modular device using a plurality of brick-shaped base elements 50 taken from a Duplo type construction kit. For the purposes of simplification, this figure does not show the hidden portions. Dotted lines represent shapes beneath the water level which is itself represented by a dot-dashed line. In addition, the various assembly patterns are not shown.

The various elements 50 are assembled to one another in order to define a plurality of columns mounted on the bottom wall 10 of the receptacle 1. Some of these elements could alternatively be fixed on the top faces of the rims of the receptacle, even though this configuration is not shown herein.

This plurality of columns built up from Duplo type elements 50 constitute support means 5 defining, in co-operation with the receptacle, a structure which extends, in part, above the level of the liquid contained in the receptacle 1.

A water delivery box 4 having the standardized assembly pattern is mounted in a selected position on the above-water portion of the structure, and preferably at the highest point thereof. It includes a water inlet 40 and a plurality (e.g. two) of water outlets 41 and 42 which are advantageously provided with anti-splash means.

Means 6 are also provided for raising the water from the receptacle 1 to the box 4. These means comprise, for example, a pump 60 having its suction inlet connected to one of the cylindrical orifices 110 of the receptacle, and having its delivery outlet connected to the inlet 40 of the box 4. A water flow rate adjusting device, e.g. of the valve type (not shown) may be provided at the pump or at the box. When situated at the box, the adjustment device may be situated on the water inlet 40, or else on each of the outlets. The pump is assumed to include the standardized or uniform assembly pattern so as to enable it to be mounted on one of the rims of the receptacle, for example.

When using only one receptacle 1, the other three cylindrical orifices 110 are closed by means of appropriate plugs which may optionally be removed when emptying the receptacle.

In another embodiment, the pump may be directly connected to the bottom of the receptacle, with suction taking place directly without using a pipe, and with all four orifices 110 being closed.

The various gutters 3 are mounted in selected positions on the various columns of the support means 5 so as to co-operate with one another and/or with the receptacle by means of jets of water. Some of the gutters, provided with water stop means 31, cause the liquid to flow in one direction only. Others may be bent and/or may have both ends constituting water outlets.

Other water-conveying elements 3 such as paddle wheels may be used for demonstrating the driving aspect of water by making the wheel rotate.

Figure 9:
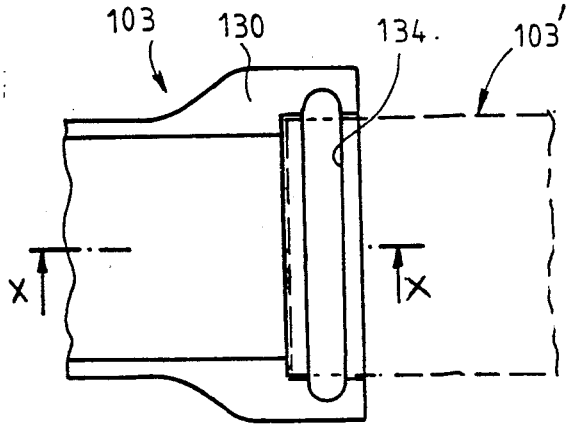
FIG. 9 is a diagram showing another embodiment of liquid-conveying means.
Figure 10:
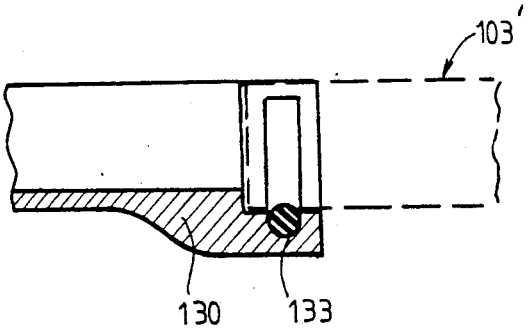
FIG. 10 is a section on X—X of FIG. 9.

In a variant (FIGS. 9 and 10) some of the gutters 103 may be interconnected to one another so as to co-operate in conveying water flow. In this case, the end of the gutter side wall 130 is provided with an enveloping circular lip having an annular groove 134 formed therein suitable for receiving sealing means 133 such as an O-ring. The free end of another gutter 103' then co-operates with the circular lip and the O-ring of the gutter 103.

The compatibility between this device and elements taken from Duplo and/or Lego type construction kits make it particularly easy to use. This compatibility also enhances the modularity of such a device and makes it possible to construct a very wide variety of water paths. Thus, even when using gutters of substantially identical shape, water paths can be diversified by mounting them on base elements oriented in different directions.

Figure 11:
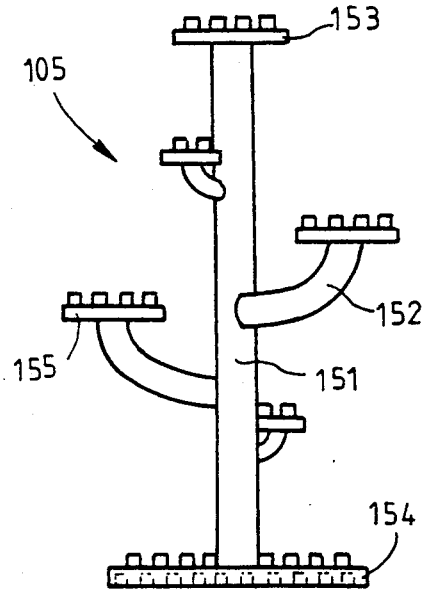
FIG. 11 is a diagram showing another embodiment of the support means.
Figure 12:
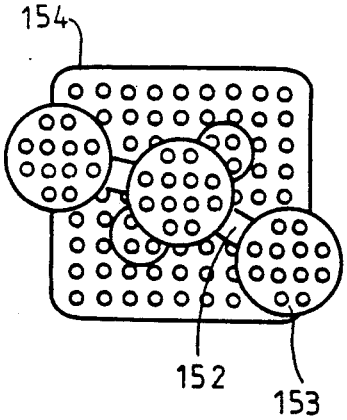
FIG. 12 is a plan view corresponding to FIG. 11.

It is also possible to use support means 105 constituted by a single-piece element as shown in FIGS. 11 and 12. This element includes a base platform 154 provided with the standardized assembly pattern and intended to be mounted on the bottom wall of the receptacle. This base platform 154 has an upstanding main portion 151 such as a column extending to a top platform 153, likewise including the standardized assembly pattern and intended to receive one or more gutters. A plurality of auxiliary portions 152 are also provided which are fixed to the central column 151 and which support respective secondary platforms 155 at their free ends, likewise provided with the standardized assembly pattern.

Figure 13:
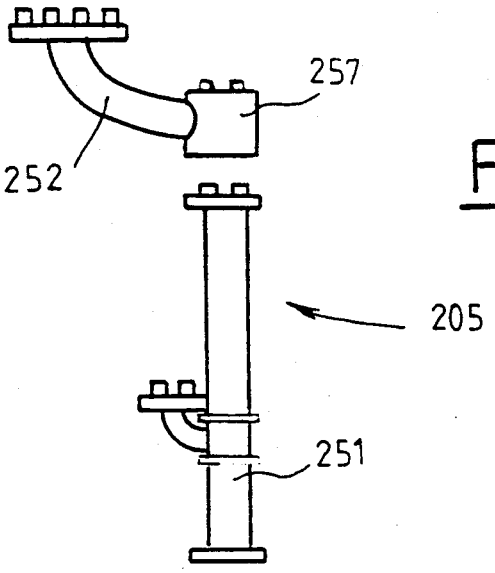
FIGS. 13 to 15 are diagrams showing yet another embodiment of the support means.
Figure 14:
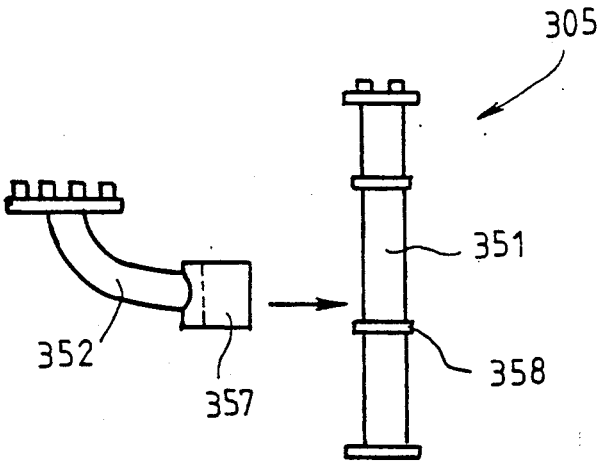
Figure 15:
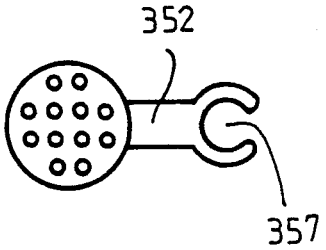

The modularity of this type of support can be increased by providing embodiments such as those shown in FIGS. 13, 14, and 15.

In FIG. 13, the auxiliary portion 252 has a base 257 provided with the standardized assembly pattern enabling it to be removably connected to the main portion 251.

In FIGS. 14 and 15, the main portion 351 has an annular projection 358. The base 357 of the auxiliary portion 358 includes an open ring portion which clamps on the main portion 351 and bears against the annular projection 358. The annular piece 357 could also be designed to co-operate with an annular groove in the main portion 351.

This additional modularity of the support means also enables the stiffness thereof to be reduced, thus reducing fragility.

In order to further increase the capacity of the kit, it is possible to couple together two analogous receptacles (FIG. 16). In this case, the two receptacles are assembled via their side rims. More particularly, a lower level side rim (e.g. 114') engages beneath a higher level side rim (e.g. 112) using assembly studs 20' and 21' and hollows 22. The two receptacles then communicate via their corresponding cylindrical orifices 110 and 110' which are interconnected by a connection sleeve 9 which is advantageously provided with sealing means 90 such as O-rings. By having the receptacles co-operate with each other via their side rims, there is no danger of water splashing between them. In addition, using such connection sleeves makes it possible to use only one pump for a set of receptacles.

Although the embodiments described above take full advantage of the invention, it has been found to be even better to provide an embodiment in which the device is provided with means for retaining the liquid contained in the receptacle, such retaining means being suitable for minimizing the quantity of liquid that may be spilt from a receptacle when the receptacle is moved. The term "moved" should be understood in this context in a very wide sense, covering not only the case where the receptacle is tipped over, but also, for example, the case where a receptacle receives a sudden shock which could cause waves in the liquid contained therein.

Figure 17:
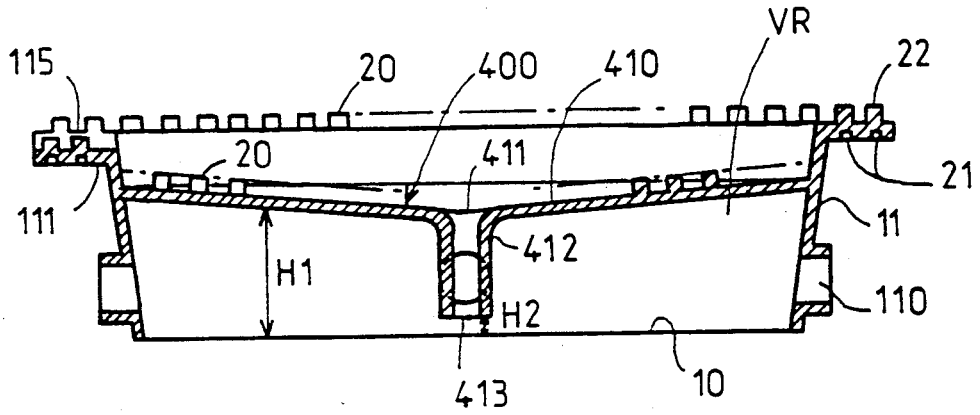
FIG. 17 is a diagrammatic cross-section through another embodiment of the device of the invention.

In general, the retaining means include an intermediate wall situated at a first distance from the bottom wall of the receptacle and bearing against its side wall. This intermediate wall is pierced by at least one orifice extended by a duct opening out facing a selected zone of the bottom wall, and at a second distance therefrom. All of these walls are then mutually disposed to delimit a selected internal retaining volume. Such an embodiment is shown diagrammatically in FIG. 17 which differs from FIG. 2 by the addition of retaining means 400.

The intermediate wall 410 is pierced in this case in its center by an orifice 411 which is extended towards the bottom wall 10 of the receptacle by a duct 412 whose free end 413 opens out and is situated at a distance H2 from the bottom wall 10 and substantially facing the center thereof.

The intermediate wall 410 is shown as being fixed to the side wall 11 of the receptacle. Naturally, the intermediate wall could be designed to bear against the side wall by any other connection means, and in particular it could be removable.

The person skilled in the art will be able to adapt the geometrical shape of the intermediate wall so as to ensure that liquid from the liquid-conveying elements is forced to flow towards the orifice 411. For example, this wall may be slightly dished.

The first distance H1 between the intermediate wall 410 and the bottom wall 10, and the mutual dispositions of all of the walls are selected so as to delimit an internal retaining volume VR which is at least twice the volume of liquid used in the device. In addition, the distance H1 is also selected so preserve a sufficient height of side wall above the intermediate wall.

Further, the second distance H2 is selected to be no more than half the distance H1, and the opening out end 413 thereof is situated substantially in the vicinity of the bottom wall.

The person skilled in the art will then understand that such a disposition of the retaining means 400 serves to minimize liquid spills from the receptacle regardless of the position taken up by the receptacle. For example, with the retaining volume VR at least twice the volume of the liquid used, and with the distance H2 no more than half the distance H1, minimum spillage will occur even if the receptacle were to be inverted.

In this case, there is no need for the bottom wall 10 to be provided with the first assembly pattern. However, it is advantageous, although not essential, for the top face of the intermediate wall to possess said first assembly pattern 20.

The Applicants have observed that it is not essential for the orifice 411 to be situated in the center of the intermediate wall. The orifice may be eccentric providing the ducts 412 opens out substantially facing the center of the bottom wall. Similarly, it is possible to provide a plurality of orifices 411 extended by respective ducts opening out facing the bottom wall.

It should also be observed that using retaining means is not incompatible with the variant of the invention where at least one additional receptacle is provided as shown in part in FIG. 16. To this end, the respective opening ducts 412 of the intermediate walls 410 of the two receptacles may be designed to open out substantially in the vicinity of respective cylindrical orifices 110 which are interconnected by the connection sleeve. Thus, the opening out ends of the respective ducts 412 are situated substantially at the center of an area defined by the two bottom walls of the two receptacles.

The invention is not limited to the embodiments described above but it encompasses all variants thereof, and in particular the following:

The liquid-conveying elements may be of various shapes, e.g. S-shaped or spiral-shaped. The structure may also be equipped with liquid-conveying elements other than gutters, e.g. in the form of gargogyles or any other water statuettes. Some such elements, e.g. water millwheels, may be connected directly to the pump by a pipe, in which case the pipe constitutes a portion of the water distribution means. Such elements may also be connected directly to the water box by means of pipes.

The means for raising water need not be mounted directly on the structure. It is also possible to provide a plurality of water outlets from the distribution box, with each outlet having its own flow rate controlling means.

The distribution box may be replaced by the outlet ends of a plurality of pipes fixed on an appropriate support.

The above description is in terms of a standardized assembly pattern of the type having co-operating studs. It would also be possible to use assembly patterns of different types for different interfaces between the component parts of the device.

The second assembly pattern is particularly advantageous in this case. However, it could be fitted to other modular elements compatible with those of construction kits of the type having co-operating studs and usable in other applications.

It would also be possible to have a receptacle side wall which is higher than that described. It could then include at least a portion of the support means.

The invention is not limited to the application to devices for construction kits and it may be used, for example, as an interior decorating device including waterfalls or fountains. It could also be used in aquatic parks, in which case the device would be larger in size. In such an application, the receptacle could be a concreted basin dug in the ground.

Naturally, some of the means described above may be omitted in variants where they are not used.

We claim:

1. A modular device comprising, in combination:

a receptacle (1) for containing a liquid;

support means (5) connectable to the receptacle to define, together with said receptacle, a structure extending in part above the level of liquid contained in the receptacle, said structure being provided with support surfaces, each provided with a plurality of assembly components in a first predetermined pattern;

a plurality of liquid-conveying elements (3) each possessing a plurality of assembly components in a second predetermined pattern complementary to the first pattern for releasable locking engagement with the assembly components on said support surfaces, said elements being independently mountable on said support surfaces, by engagement of said assembly compontents of said liquid-conveying elements with said assembly components of said support surfaces in positions aligned for conveying the liquid directly from one liquid-conveying element to another and/or to the receptacle;

liquid-distribution means (4) co-operating with at least one of the liquid-conveying elements; and liquid-raising means (6) for raising liquid from the receptacle to the liquid-distribution means.

2. A device according to claim 1, characterized in that the liquid-conveying elements comprises gutter elements mounted on the structure in mutual liquid-receiving co-operation for flow of liquid therebetween.

3. A device according to claim 1, characterized in that said liquid-distribution means comprise a distribution box (4) suitable for being mounted in a selected position on a portion of said structure extending above the level of liquid in the receptacle.

4. A device according the claim 2, characterized in that at least some of the gutter elements include liquid stop means (31) situated at an end thereof.

5. A device according to claim 4, characterized in that the support means (5) comprise a plurality of base elements (50) each possessing assembly components in said first pattern for connecting said base elements to one another and to the receptacle.

6. A device according to claim 4, characterized in that the support means (105) comprise a main portion (151) connected to the receptacle and a plurality of auxiliary portions (152) connected to said main portion and having free ends, with at least some of said auxiliary portions possessing assembly components in said first pattern at their free ends.

7. A device according to claim 6, characterized in that the assembly components of said first pattern comprise projecting studs.

8. A device according to claim 7, characterized in that the second assembly pattern comprises two rows of projecting pegs spaced apart at a pitch p identical to the pitch between pairs of adjacent pegs within the same row, and in that the pitch p is substantially equal to 2.4 times the outside diameter of each peg.

9. A device according to claim 8, including liquid-retaining means (400) for retaining the liquid contained in the receptacle, said liquid-retaining means being suitable for minimizing the quantity of liquid split from the receptacle when the receptacle is moved.

10. A device according to claim 9, in which the receptacle includes a bottom wall (10) and a side wall (11), characterized in that the retaining means comprise an intermediate wall (410) situated at the first distance (H1) from the bottom wall (10) and bearing against the side wall (11), in that the intermediate wall (410) is pierced by at least one orifice (411) extended by a duct (412) opening out facing a selected zone of the bottom wall, and at a second distance (H2) therefrom, and in that all of the walls (10, 11, 410) are mutually disposed to delimit an internal retaining volume (VR).

11. A device according to claim 10, characterized in the second distance (H2) is not more than half the first distance (H1), and in that said selected zone is situated in the vicinity of the center of the bottom wall.

12. A device according to claim 11, characterized in that at least one of the side, intermediate, and bottom walls is provided with the first assembly pattern (20).

13. A device according to claim 10, characterized in that the bottom wall (10) and the side wall (11) are provided with assembly components in said first pattern.

14. A device according to claim 13, characterized in that said structure includes at least one additional receptacle possessing assembly components in said first pattern and also including a side wall, the two receptacles having rims at different respective heights on the side walls and being joined by said rims.

15. A device according to claim 14, characterized in that the liquid-raising means possesses assembly components in said first pattern and is mounted on said structure.

16. A device according to claim 1, characterized in that said liquid-distribution means comprise a distribution box (4) suitable for being mounted in a selected position on a portion of said structure extending above the level of liquid in the receptacle.

17. A device according to claim 1, characterized in that the support means (5) comprise a plurality of base elements (50) each possessing assembly components in said first pattern, for connecting said base elements to one another and to the receptacle.

18. A device according to claim 1, characterized in that the components of said first assembly pattern comprise projecting studs.

19. A device according to claim 18, characterized in that the assembly components of said second pattern comprise two rows of projecting pegs spaced apart at a pitch p identical to the pitch between pairs of adjacent pegs within the same row, and in that the pitch p is substantially equal to 2.4 times the outside diameter of each peg.

20. A device according to claim 1, including liquid-retaining means (400) for retaining the liquid contained in the receptacle, said liquid-retaining means being suitable for minimizing the quantity of liquid spilt from the receptacle when the receptacle is moved.

21. A device according to claim 20, in which the receptacle includes a bottom wall (10) and a side wall (11), characterized in that the retaining means comprise an intermediate wall (410) situated at the first distance (H1) from the bottom wall (10) and bearing against the side wall (11), in that the intermediate wall (410) is pierced by at least one orifice (411) extended by a duct (412) opening out facing a selected zone of the bottom wall, and at a second distance (H2) therefrom, and in that all of the walls (10, 11, 410) are mutually disposed to delimit an internal retaining volume (VR).

22. A device according to claim 1, in which the receptacle includes a bottom wall and a side wall with a free edge (111–114), the device being characterized in that the bottom wall (10) and the side wall (11) in the vicinity of at least a portion of its free edge are provided with assembly components in said first pattern.

23. A device according to claim 22, characterized in that said structure includes at least one additional receptacle possessing assembly components in said first pattern and also including a side wall, the two having rims at different respective heights on the side walls and being joined by said rims, and means communicating said receptacles for liquid flow therebetween.

* * * * *